US009963894B2

(12) United States Patent
Wares

(10) Patent No.: US 9,963,894 B2
(45) **Date of Patent: *May 8, 2018**

(54) FOLDABLE CHILDREN'S WADING POOL AND METHOD OF USE

(71) Applicant: Larry Wares, San Clemente, CA (US)

(72) Inventor: Larry Wares, San Clemente, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/375,426

(22) Filed: Dec. 12, 2016

(65) Prior Publication Data

US 2017/0089084 A1 Mar. 30, 2017

Related U.S. Application Data

(63) Continuation-in-part of application No. 14/564,481, filed on Dec. 9, 2014, now Pat. No. 9,518,399.

(51) Int. Cl.
*E04H 4/00* (2006.01)
*E02D 27/32* (2006.01)
*E02F 3/02* (2006.01)

(52) U.S. Cl.
CPC ..... *E04H 4/0018* (2013.01); *E02D 27/32* (2013.01); *E02F 3/02* (2013.01); *E04H 2004/0068* (2013.01)

(58) Field of Classification Search
CPC ..... E04H 4/0025
USPC ..... 4/488–513
See application file for complete search history.

(56) References Cited

U.S. PATENT DOCUMENTS 9,518,399 B2 * 12/2016 Wares ..... E04H 4/0018
2003/0019024 A1 * 1/2003 Tompkins ..... E04H 4/0025 4/506

* cited by examiner

*Primary Examiner* — Lori Baker
(74) *Attorney, Agent, or Firm* — Lapple Ubell IP Law, LLP; Matthew C. Lapple

(57) ABSTRACT

A foldable, portable fabric children's wading pool for installation in the ground and which has improved stability characteristics is provided. The pool includes a waterproof fabric base, a middle stabilizer section with a removable and adjustable sand stabilizer, and a sand anchor section for holding a weighting material such as sand. The pool is set up by digging a hole in the ground and forming berms along the edges of the hole. Then, the pool is unfolded and positioned such that the waterproof fabric base is in the hole, the middle stabilizer section is on the top of the sand berm, and the sand anchor section extends downwardly and outwardly from the edge of the sand berm. The removable and adjustable sand stabilizers are put in place. Then, a weighting material is loaded onto the sand anchor section and the pool is filled with water, preferably using the waterproof bag that also serves as a storage and transport bag for the pool when folded.

23 Claims, 7 Drawing Sheets

FOLDABLE CHILDREN'S WADING POOL AND METHOD OF USE

CROSS REFERENCE TO RELATED APPLICATIONS

The teachings herein constitute a continuation-in-part of U.S. application Ser. No. 14/564,481, filed on Dec. 9, 2014, which issued as U.S. Pat. No. 9,518,399 on Dec. 13, 2016. The benefit of this earlier filing date is claimed, and the content thereof is incorporated herein by reference as though fully set forth herein.

BACKGROUND

Going to the beach, either at the ocean or at a lake, is a common and beloved pastime for families. However, trips to the beach often present challenges to families with young children, particularly with respect to the safety and comfort of the children. Specifically, young children who have not yet learned to swim, or who are weak swimmers, should generally not be allowed to play in waves or rough surf. Further, for much of the year, although air temperatures may be pleasant, water temperatures remain too cold for young children. This is particularly true along the Pacific Coast of California. Nevertheless, few children want to go to the beach and not play in the water. As such, it has become popular to bring a portable swimming pool to the beach, filling the pool with ocean or fresh water, and permitting the child or children to bathe or swim therein. These portable pools are well known in the prior art and typically are inflatable or molded from plastic.

Such prior art portable pools are cumbersome, take up significant room in the family's vehicle, and tend to be unstable in the sand. Therefore, it would be advantageous to provide a portable wading pool for use at the beach which is easily transportable and stable when in place at the beach. Prior art portable pools also generally fail to address the fact that, when filled with cold ocean water, they take considerable time to warm up to a temperature which would be comfortable for small children to bathe in.

Some prior art approaches to solving the problems of transportability and stability have focused on positioning a rubber or fabric pool in a hole dug into the sand. However, each of these prior art approaches suffer from various instability and inconvenience problems. U.S. Pat. No. 5,881,402, entitled, "Portable In-Ground Pool," issued to Devino on Mar. 16, 1999, discusses a portable pool for beach use which employs an inflatable circumferential ledge which is secured into the sand utilizing stakes. Several disadvantages of this prior art pool are the fact that it must be inconveniently staked down and inflated to try to achieve stability. However, it is likely still unstable and prone to deformation of the pool and collapse of the sand sidewalls, or to having the stakes pulled out of the sand when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool.

Published Patent Application No. US 2007/0248414 A1, entitled, "Method and Apparatus for Making a Pool," was filed by Ralph Fratianni on Apr. 20, 2007, and was published on Oct. 25, 2007. This published application discusses an apparatus for forming a pool including a panel of waterproof material supportable by a surface of a concaved area of sand and at least one sleeve or pouch coupled to or formed in an outer edge of the material, the at least one sleeve or pouch capable of holding a weighting substance and preventing an entire outer edge of the material from being relocated by the wind. Disadvantages of this prior art pool include instability and a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool. Moreover, the described sleeve or pouch would appear to be difficult to load and unload with weighting material that is readily available at the beach, namely sand.

Published Patent Application No. US 2012/0023655 A1, entitled, "Portable Swimming Pool for Beach Use," was filed by Jeffrey Junquet on Jul. 26, 2011, and was published on Feb. 2, 2012. This published patent application discusses a portable swimming pool for use at the beach formed from vinyl or other flexible waterproof material comprising a circular base and a side wall that extends upward from the base and tapers outward as it extends up. To use it, a user digs a hole and unfolds the pool into the hole. The Junquet portable swimming pool, discussed, also includes a sand apron extending outwardly from the edge of the side wall, which can be laid out on the surface of the sand next to the hole, and then covered with sand, which allegedly provides stability. Disadvantages of this prior art pool include instability in the interface between the pool and the sand, a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and, due to the sand apron laying flat on the surface of the sand—and then be covered with a layer of sand—having undue amounts of sand to fall into the pool as children enter and exit it.

Thus, there is a need to be able to have a portable wading pool that that is stable, with respect to both wind and shifting sand, is able to easily allow children to climb into and out of the pool, while withstanding the rigors of children climbing into and out of the pool when filled with water and not filling with spilled sand. Additionally, a portable wading pool that warms water quickly for use with cold ocean water is needed and preferable.

SUMMARY OF THE INVENTION

The present invention addresses and alleviates these problems with prior art. While various embodiments of the foldable children's wading pool of the present invention exist, as will be understood by one of ordinary skill in the art, each generally includes a foldable fabric sheet, with a waterproof fabric base region, a middle stabilizer region attached to or contiguous with that base region, and with an attached but removable and adjustable sand stabilizer foam strip, and with a sand anchor region attached to or contiguous with the middle stabilizer region, with at least one upwardly projecting sand anchor to engage weighting material such as sand.

The approach taken by the present invention foldable pool is to provide a portable pool which is situated into a hole dug into the beach sand, using sand berms along the edges of the hole; whereby said berms are engaged by the pool sidewall, the middle stabilizing section and the sand anchors, in order to provide lateral support and stability to the pool.

DETAILED DESCRIPTION OF THE PREFERRED EMBODIMENTS

Figure 1:
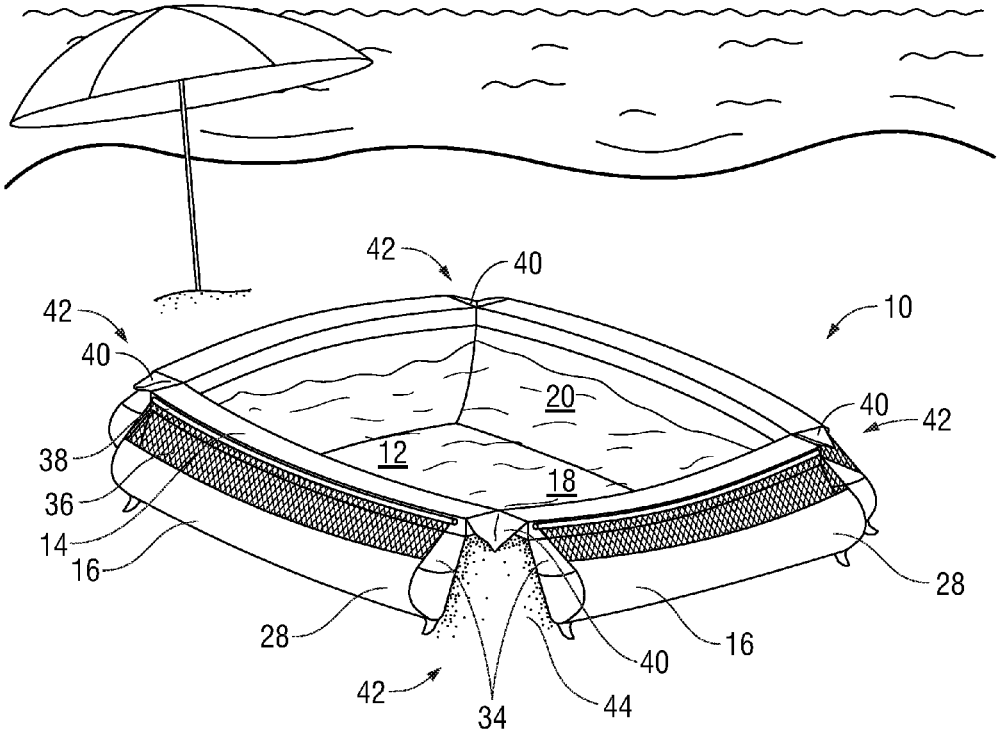
FIG. 1 is a perspective view of an embodiment of a foldable children's wading pool of the present invention that is in use at a beach.

A first embodiment of the portable children's wading pool 10 is illustrated in FIG. 1. The pool 10 includes a waterproof fabric base 12, a middle stabilizer section 14, and a sand anchor section 16. The waterproof fabric base 12 has a bottom section 18 and at least one side section 20. In the embodiment shown, the waterproof fabric base 12 has four side sections 20, each of which is bonded, sewn or otherwise attached to the bottom section in a manner that will ensure that the entire waterproof fabric base 12 will remain generally waterproof. The bottom section 18 of the waterproof fabric base 12 is generally oval shaped, and each of the side sections 20 are generally trapezoidal, such that when the pool 12 is unfolded and in place, the side sections 20 generally taper downwardly and inwardly toward the bottom section 18. The waterproof fabric base 12 can be comprised of any suitable waterproof material, such as but not limited to polyester canvas with polyurethane coating, plasticized polyvinyl chloride (PVC) and, or low-density polyethylene (LDPE). Preferably, it is comprised of a waterproof fabric material that is durable when repeatedly exposed to water, salt water, sand and sun. Further preferably, the waterproof fabric base 12 is a dark color, for example black or dark grey, so that when the sun strikes it, the material will warm quickly and help heat up any water in the pool when it is filled.

Figure 6:
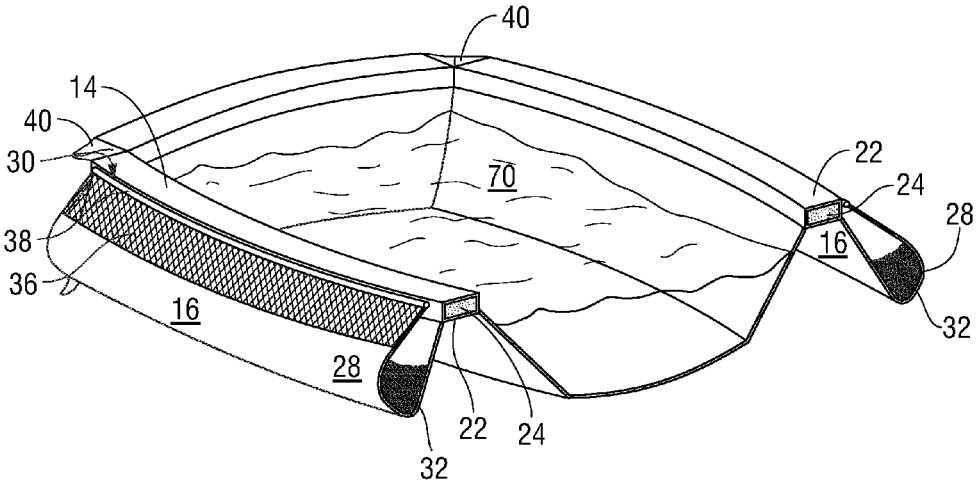
FIG. 6 is a cutaway perspective view of an embodiment of a foldable children's wading pool of the present invention that is in use.
Figure 7:
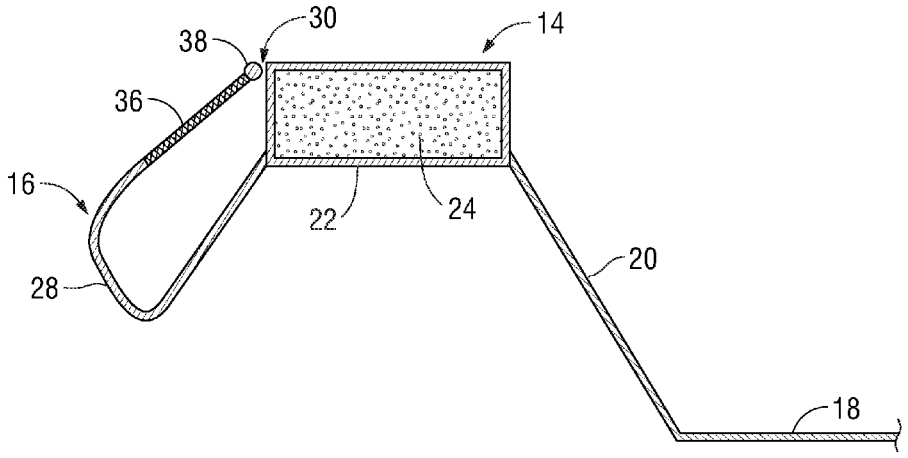
FIG. 7 is a not-to-scale side cutaway drawing of one embodiment of a foldable children's wading pool illustrating the middle foam stabilizer section and the sand anchor pocket.
Figure 8:
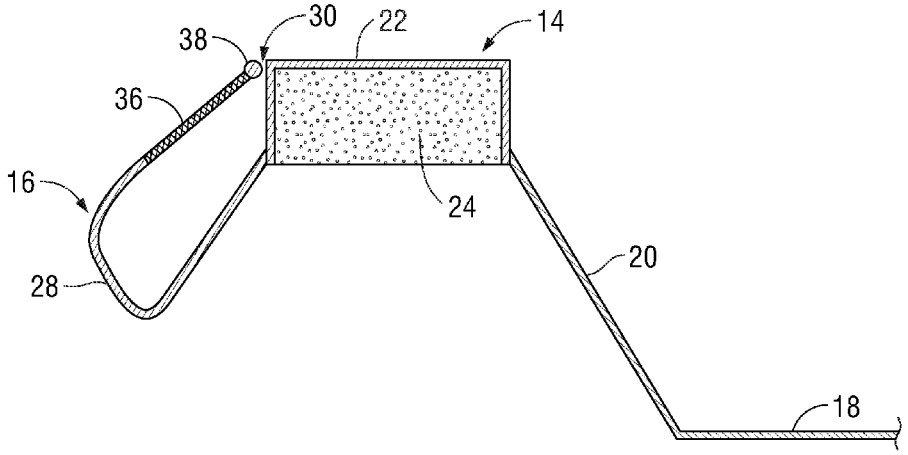
FIG. 8 is a not-to-scale side cutaway drawing of another embodiment of a foldable children's wading pool illustrating the middle foam stabilizer section and the sand anchor pocket.

The portable children's pool 10 is stabilized against being blown by the wind and against shifting sand caused by the entry and exist of children into the pool by the integrated action of the middle stabilizer section 14 and the sand anchor section 16. As shown in greater detail in FIGS. 6-8, the middle stabilizer section 16 is comprised of fabric 22 and a foam stiffening strip 24. The fabric 22 may be the same kind waterproof fabric used for the waterproof fabric base 12, or it can be any fabric that is suitably durable when exposed to water, salt water, sand and sun. The foam stiffening strip 24 is attached to the fabric 22 by stitching, gluing or any other suitable method known to one of ordinary skill in the art. As shown in FIGS. 6 & 7, the fabric 22 may entirely enclose the foam stiffening strip 24, or alternatively, as shown in FIG. 8, the fabric 22 may be attached to the top of the foam strip 24. Alternatively the foam stiffening strip 24 may be attached to the top of the fabric 22, although that embodiment is not explicitly shown.

The foam stiffening strip 24 may be comprised of any foam that will provide increased rigidity to the middle stabilizer section without preventing the middle stabilizer section 14 from being folded for storage. Preferably, the foam stiffening strip 24 is pre-creased at specific intervals to aide a user in the folding operation. Also preferably, the foam stiffening strip is comprised of a closed-cell foam, in order to prevent absorption of water resulting in increased weight and waterlogging during and after use. For example, the foam stiffening strip 24 may be made from foams including polyethylene, cross-linked polyethylene, expanded polystyrene ("EPS"), neoprene rubber and "gym rubber," i.e., polyvinyl chloride nitrile butadiene rubber (PVC/NBR).

The middle stabilizer section 14 is attached to, or an integral extension of, the waterproof fabric base 12. Preferably, the fabric 22 of the middle stabilizer section 14 is attached to or an integral extension of the side sections 18 of the waterproof fabric base 12.

The sand anchor section 16 is attached to, or an integral extension of, the middle stabilizer section 14. Preferably, the fabric of the sand anchor section 16 is attached to or an integral extension of the middle stabilizer section 14. As shown in FIGS. 1, and 6-8, the sand anchor section is a sleeve 28 of fabric that extends for the entire length of the middle stabilizer section 14. The sand anchor sleeve 28 is open at its top 30, although in alternate embodiments, it can be closed. The open top 30 of the sleeve 28 is preferable in order to enable easy loading and unloading of a weighting material, such as sand 32, into the sand anchor section 16 when the pool 10 is being set up. Preferably, the sleeve 28 is also open, or primarily open, at each end 34 of each sleeve 28. The open ends 34 of the sleeve 28 enable the easy unloading of the weighting material from the sleeve 28 of the sand anchor section 16 when the pool 10 is being put away for travel and storage. The ends of the sleeve may also be partially closed, in order to help retain the weighting material. Further, in a preferred embodiment, the sand anchor section 16 has a mesh window 36 at the top of the sleeve 28. This mesh window 36 is made of any suitable mesh that will be durable when exposed to water, salt water, sand and sun. The mesh window 36 also increases the ease with which weighting material can be loaded and unloaded into the sand anchor section 16, as well as provides an easy way to see how much weighting material has been loaded into the sand anchor section sleeve 28. Additionally, the mesh window 36 can have an elastic cord 38 integrated into or attached to the top edge of the mesh. This elastic cord 38 is preferably attached to the fabric of either the sand anchor 16 or the middle stabilizer section 14 at at least two points, namely the ends 34 of the sand anchor section 16. The elastic cord 38 may also be attached to the fabric at convenient intervals along either the sand anchor section 16 or the middle stabilizing section 14. The elastic cord 38 assists in the ease of loading the sand anchor section 16 with weighting material, because it can be stretched open, but also assists in the retention of weighting material, because it pulls the mesh top window 36 tight against the fabric of the sand anchor section 16 or middle stabilizer section 14, when weighting material such as sand 32 is loaded into the sand anchor section 16 as shown in FIG. 6.

In the embodiment shown in FIG. 1, the middle stabilizer section 14 and attached sand anchor section 16 are divided into four segments. Each segment is attached to the waterproof fabric base 12 at the outside edge of the adjacent waterproof fabric base side section 20. In a preferred embodiment, adjacent segments of the divided middle stabilizer section 14 are attached to each other by a gusset 40 of fabric at each of the corners 42 of the pool 10. Each gusset 40 serves to strengthen the respective corner 42 of the pool 10 while at the same time allowing the foam stiffening strip 24 to be divided, thereby allowing easier folding of the pool 10 when it is to be transported and stored. The gusset 40 also allows the sand anchor section 16 to be separated into segments and not present at the corners 42 of the pool 10, thereby making it easier to approach, enter, and exit the pool at the corner 42 without stepping on the sand anchor section 16. The gusset 40 may be a simple extension of the fabric 22 that comprises the middle stabilizer section 14. It may also be a separate piece of strong fabric that is sewn or otherwise attached to each of the adjacent middle stabilizer section 14 segments.

Figure 9:
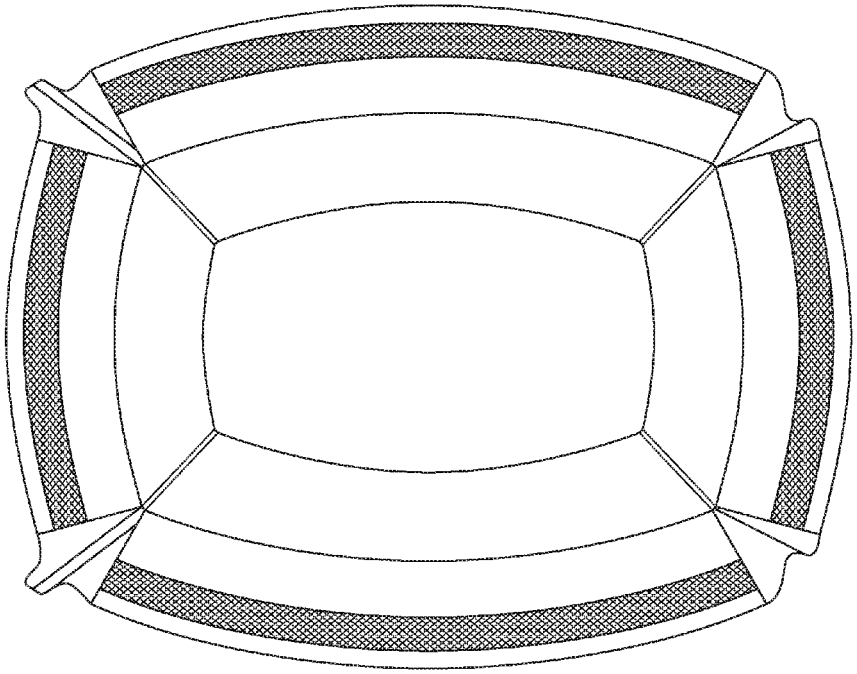
FIG. 9 is a top view of the embodiment of the foldable children's wading pool of FIG. 1.

While it will be appreciated by one of ordinary skill in the art that the pool can be of any shape, the pool 10 of FIGS. 1-9 is configured as a generally-oval shaped pool. As used herein, the term "generally oval-shaped" is meant to refer to the non-polygon shape of the pool shown in FIG. 1 and as seen from above in FIG. 9. Namely, when viewed from above, as shown in FIG. 9, it is reminiscent of a square or rectangle, but each of the sides has been bowed or curved outwardly. This generally oval shape is made by adjusting the size and shape of the bottom section 18 of the waterproof fabric section 12, the generally trapezoidal side sections 18 of the waterproof fabric section 12, and forming each of the four segments of the middle stabilizer section 14, as a curve. In general, when the pool 10 is configured in a generally oval-shape as defined above, such a configuration improves both sand hole sidewall stability as well as the ease with which small children can enter and exit the pool without impacting its stability. When a hole is dug in the sand in a generally oval shape, rather than using straight line edges, the side walls of the sand hole, as well as the edges of the hole are generally more stable and durable. Further when the pool 10 is configured in a generally oval shape as shown, small children often find it easier to enter and exit the pool at the corners 42 of the pool 10, because they do not have to step over or on the sand anchor section 16. Further, by stepping on the corners 42 of the pool 10, the gussets 40, or the sand berm 44 at the corner of the hole, any child that is entering or exiting the pool will not crush down the sand berm 44 by stepping on the middle stabilizing section 16. Additionally, if the child steps on the corner gusset 40 of the pool 10, the weight of the child will be distributed across the fabric—and anchoring weight—of two adjoining sand anchors 16, rather than on a single sand anchor, thereby reducing the force that would otherwise pull the middle stabilizing section 14 and the sand anchors 16 toward the center of the pool 10. Finally, this method of ingress and egress, which is in part facilitated by the shape of the pool and the use of the fabric gussets, serves to minimize the amount of sand that is accidently kicked or poured into the pool.

While not intended to be limiting in any way, in one embodiment of the present invention, the pool is approximately three feet, 6 inches long and 2 feet, 6 inches wide. The middle stabilizer section is approximately 4 inches wide and about one-half to one inch thick. The sand anchor section extends downwardly about 6-8 inches. Further, in this embodiment, the pool can be filled with approximately 18 to 24 inches of water, as measured from the bottom of the bottom section of the waterproof fabric base.

Figure 2:
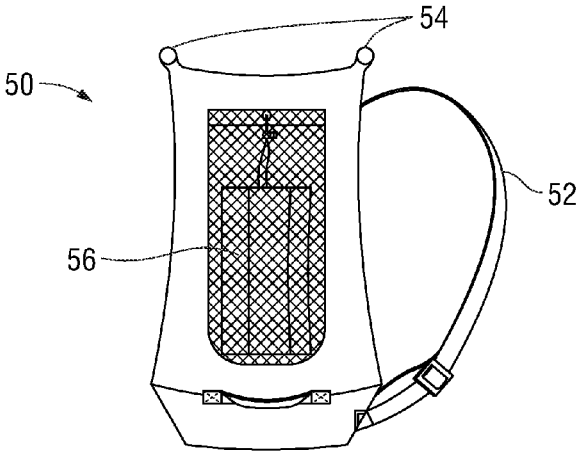
FIG. 2 is a side view of a waterproof bag into which the foldable children's wading pool of FIG. 1 can be folded for transport and storage.
Figure 3:
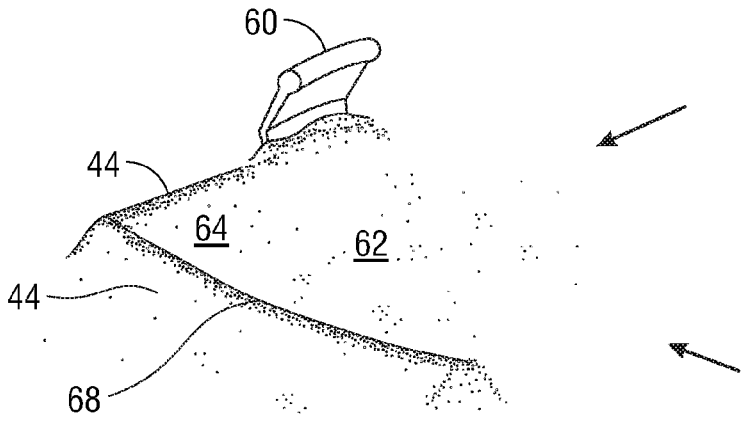
FIG. 3 is a perspective view of a step in one method of deploying the foldable children's wading pool, namely using a digging tool to form a berm in the general shape of the pool edges.
Figure 4:
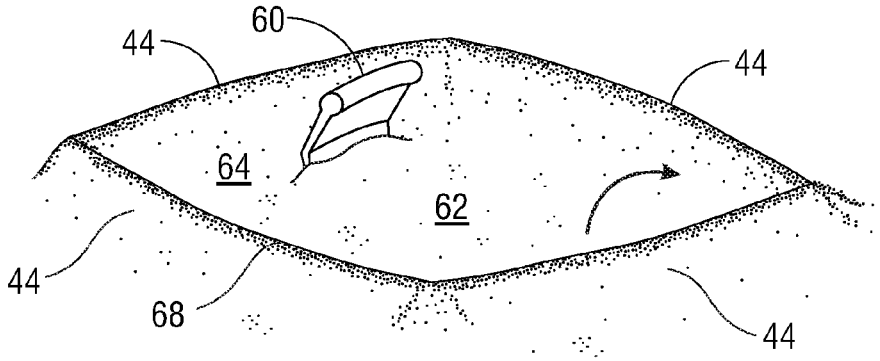
FIG. 4 is a perspective view of another step in a method of deploying the foldable children's wading pool, namely using a digging tool to form a hole with berms along the edges of the hole in the general shape of the pool edges.
Figure 5:
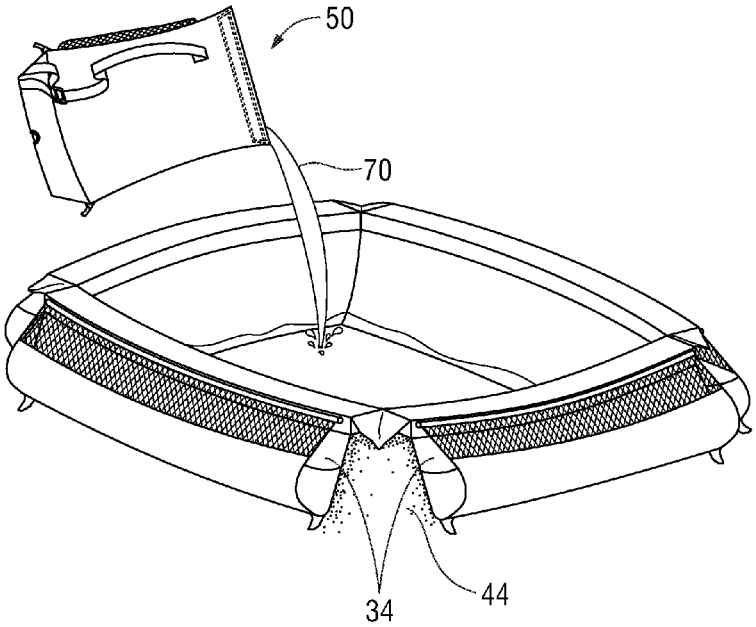
FIG. 5 is a perspective view of another step in a method of deploying the foldable children's wading pool, namely using the waterproof bag to pour water into the unfolded and in-place pool.

FIG. 2 illustrates a bag 50 for use with the pool 10. The bag 50 preferably has an assortment of straps 52 and handles 54 for carrying the bag, as well as pouches 56 for carrying beach accessories. The bag is preferably large enough for the entire pool 10 to be folded and stored within the bag 50. Further, preferably, the bag 50 is made of a waterproof material so that it can be used as bucket for carrying water and filling the pool, as described further below.

In FIGS. 1 & 6, the portable children' pool 10 is shown in use at the beach. Specifically, as discussed further below, the pool 10 is unfolded, in-place in a hole with side berms in the sand, filled with water, and with the sand anchor pockets and in use at the beach. The pool 10 is set up and put in place via a series of steps illustrated in FIGS. 3-6. First, a digging tool 60, or even a user's hands, are used to outline a hole 62 in the sand that is roughly the same size as the pool 10. The user then digs the hole 62, which should taper downward and inwardly from the edges of the hole. The user also should form sand berms 44 along the edges of the hole. These sand berms 44 should be taller than the surface of the surrounding ground and generally an extension of the side walls 64 of the hole 62. The user then unfolds the pool 10 and inserts it into the hole 62. The pool 10 should be oriented so that the waterproof fabric base 12 is in the base of the hole 62. The pool 10 should be further oriented so that the middle stabilizer section 14 of the pool 10 is placed at the top 68 of each of the sand berms 44. Then, the sand anchors 16 should extend outwardly and down the outside sides of the sand berms 44. This configuration will enable the filled sand anchors 16 and the water 70 in the filled pool 10 to weigh down and press against opposing sides of the sand berm, pulling the middle stabilizing section 14 down against the top 68 of the sand berm 44. This configuration will result in a push/pull effect that stabilizes the sand at the edge of the pool, minimizes the amount of deformation to the sand wall sides of the hole that might otherwise occur when children step on the edges or sides of the pool, prevents or minimizes the fabric of the pool from being pulled downward in a way that water will spill out of the edge of the pool, and in the event of localized deformation of the sand side wall or berm, prevents instability or failure of the entire sand side wall or sand berm.

The user then uses sand 32 or other weighting material, such as pebbles or dirt, to fill the sand anchors. This is accomplished by either using sand excavated from the hole, or from other available materials. The user can insert the weighting material by pulling back the open top 30 of each sleeve 28 of the sand anchor section 16 and pouring the material in, then evenly distributing it across the length of the sleeve 28. Then, the user fills the pool 10 with water 70 or other liquid. Preferably, the user can use the waterproof fabric bag 50 as a bucket to scoop water 70 from the ocean or lake, and then pour it into the pool 10. On completion of the setup, the pool is configured as shown in FIG. 6.

When fully set up, children can play in the pool. Preferably, due to the generally oval shape of the pool, as well as the use of the segmented middle stabilizer section 14, segmented sand anchor section 16 and gussets 40, children will naturally climb into and out of the pool at the corners 42 of the pool 10, thereby minimizing stepping on, tripping on and compressing the sand anchor section 16, the middle stabilizer section 14, the sand berms 44 and sand side walls 64 of the hole 62.

When the user is ready to take the pool down, this process can be reversed. Preferably, the weighting material can be easily swept out of the sand anchor section 16 at the open ends 34 of each sleeve 28. Then, any water 70 which has not been dipped out with the bag 50 can be simply dumped out into the hole when the pool 10 is lifted. Finally, the pool 10 is folded, with folds being made at the pre-creased locations in the middle stabilizer section 14, and then stored in the waterproof fabric bag 50.

Figure 10:
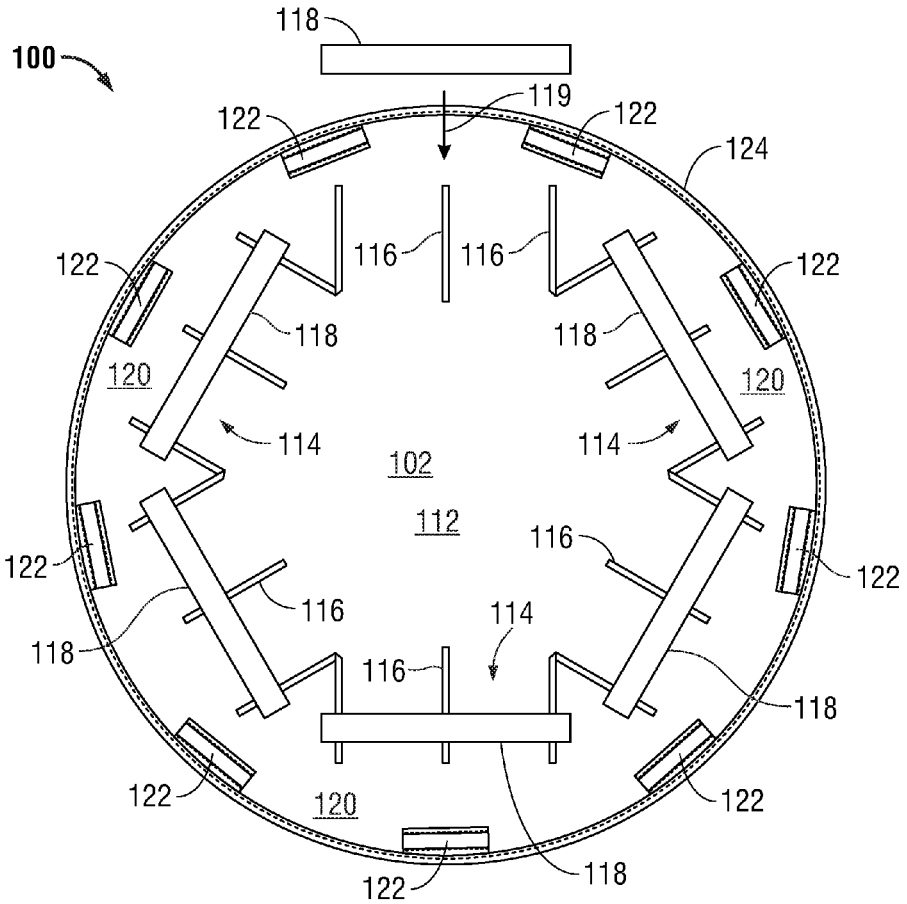
FIG. 10 is a top view of another embodiment of a foldable children's wading pool of the present invention.
Figure 11:
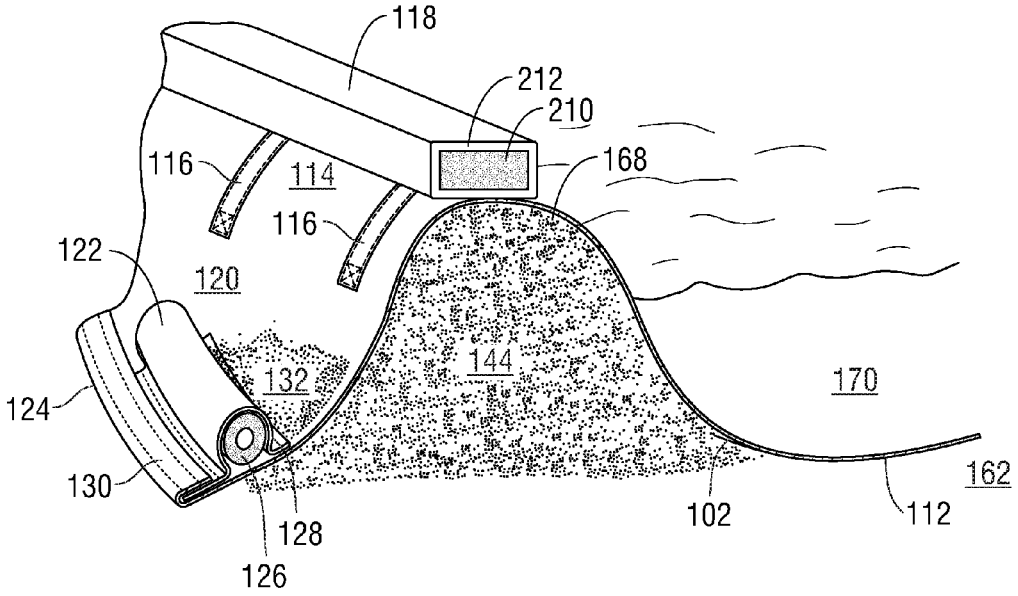
FIG. 11 is a not-to-scale cutaway perspective view of the embodiment of a foldable children's wading pool shown in FIG. 10.

An alternate embodiment of the pool is illustrated in FIGS. 10-11. The alternate embodiment of the pool 100 includes a fabric sheet 102 with a waterproof base region 112, a middle stabilizer region 114, and a sand anchor region 120. The fabric sheet 102 may be circular in shape, as illustrated, or may be oval, or any other convenient shape. For convenience, in manufacturing, the entire fabric sheet can be a single sheet of waterproof fabric, such as any of the waterproof fabrics discussed herein. The base region 112 is generally at the center of the fabric sheet 102, and when in use, some or all of the base region 112 will be depressed into a sand hole and water will be poured into and held by the base region 112.

The middle stabilizer region 114 is generally located radially outwardly from the base region 112. The middle stabilizer region includes one or more sand stabilizer affixing means 116, and one or more removable sand stabilizers 118. These sand stabilizer affixing means 116 may be any generally know fastening means, such as Velcro strips, zippers, snaps, hooks, hook-and-eye fasteners, clips, loops, tie-downs, cords, or cinch-able cords. It will be understood that each of the removable sand stabilizers 118 may also have a corresponding affixing means (not shown) that will engage with the sand stabilizer affixing means 116. Preferably, the sand stabilizer affixing means 116 and the corresponding affixing means are Velcro strips. Further preferably, the sand stabilizer affixing means 116 is the "soft" (loop) side of Velcro, and the corresponding affixing means is the "hard" (hook) side of Velcro. This configuration ensures that when children enter, exit, and play in the pool 100, if they contact the Velcro embodiment of the sand stabilizer affixing means 116, they will not scrape or irritate their skin by contact with the hard Velcro hooks, but will instead only contact the soft loop side of the strip of Velcro.

Each of the removable sand stabilizers 118 is preferably a closed-cell foam block 210, enclosed in a fabric envelope 212. While the embodiment shown in FIGS. 10-11 illustrate the removable sand stabilizers 118 as rectangular, it will be understood that they may have any shape, including a tube, an arc, a square or a trapezoid. The fabric may be any suitable fabric that is water, salt water, sand and sun resistant, as discussed above with respect to other embodiments of the invention. Preferably, the corresponding affixing means is attached to the underside of the fabric envelope 212. That said, the fabric envelope 212 may be omitted in embodiments where the corresponding affixing means can be directly attached to the closed cell foam. Moreover, in embodiments where no corresponding affixing means is needed, such as the embodiments discussed above that use loops, ties, or cinch-able cords as the sand stabilizer affixing means, the corresponding affixing means may be omitted.

The sand anchor region 120 is generally located radially outwardly from the middle stabilizer region 114. The sand anchor region 120 includes a number of alternative embodiment sand anchors 122. Each sand anchor 122 is generally located near the edge 124 of the sand anchor region 120, and thus the edge 124 of the fabric sheet 102. In the embodiment shown, there are nine such sand anchors 122, but either more or fewer may be utilized, so long as there are a sufficient number of sand anchors to hold down the sand anchor region 120 when used as described below. Each sand anchor 122 projects upwardly from the sand anchor region 120. Preferably, each sand anchor 122 is a tubular section 126 of closed-cell foam, encased in a fabric envelope 128, that is attached to the fabric sheet 102 by stitching. The fabric envelope 128 may be any suitable fabric that is water, salt water, sand and sun resistant, as discussed above with respect to other embodiments of the invention. Alternatively, each sand anchor 122 may be a fabric pocket (not shown), an upwardly projecting plastic flange (not shown), or another similar device for catching and holding sand or other weighting material on the sand anchor region 120, when the pool 100 is in use as described below. In particular, each sand anchor 122, including any alternative embodiment, should be able to hold sand or other weighting material 132 on the sand anchor region 120 when the sand anchor region 120 is positioned so that the sand anchor region 120 slopes downwardly away from the top 168 of a sand berm 144, as illustrated in FIG. 11.

Preferably, the edge 124 of the fabric sheet 102 is covered with a protective binding 132, such as a stitched fabric binding, which may be simply a fold of the fabric sheet 102 folded back upon itself, or may be a separate fabric or plastic material. The protective binding 130 serves to protect the edge 124 against wear, fraying or other damage due to use and folding of the pool 100.

While not intended to be limiting in any way, in an embodiment of the present invention shown in FIGS. 10-11, the pool is approximately 6 feet in diameter. The middle stabilizer region is approximately one foot wide and the sand stabilizers are each about one foot, eleven inches long, two-and-a-half inches wide, and one-and-a-half inches thick. In this embodiment, the pool can be filled with approximately 6 to 24 inches of water, as measured from the bottom of the base region.

In use, the alternative embodiment of the pool 100 is used much like the other embodiment discussed above, with some differences. Specifically, as discussed further below, the pool 100 is unfolded, in-place in a hole with side berms in the sand, filled with water, and with sand or other weighting material piled onto the sand anchor region 120 and held in place by the sand anchors 122. First, a digging tool 60, or even a user's hands, are used to dig a hole 162 in the sand that is roughly circular and slightly smaller than the pool 100. The hole 162 should taper downward and inwardly from the edges of the hole 162. The user also should form sand berms 144 along the edges of the hole. These sand berms 144 should be taller than the surface of the surrounding ground and generally an extension of the side walls 164 of the hole 162. The user then unfolds the pool 100 and inserts it into the hole 162. The pool 100 should be oriented so that the waterproof fabric base region 112 is in the base of the hole 162. The pool 100 should be further oriented so that the middle stabilizer region 114 of the pool 100 is placed across the top 168 of each of the sand berms 144. Preferably, the top 168 of each of the sand berms 144 radially bisects the middle stabilizer region 114. Then, the sand anchor region 116 should extend outwardly and down the outside sides of the sand berms 144.

The user then positions each of the sand stabilizers 118 on the middle stabilizer region 114, and affixes them to the middle stabilizer region 114 by use of the sand stabilizer affixing means 116. Preferably, the sand stabilizers 118 are positioned such that they are placed at the top 168 of each of the sand berms 144. It should be noted that, because the sand stabilizer affixing means allow for each of the removable sand stabilizers 118 to be adjustably placed at a radially different location with respect to each of the other sand stabilizers 118 in the middle stabilizer region 114, as shown by arrow 119. This adjustability provides flexibility to the user in terms of the exact shape and size of the hole 162 and berms 144. Further it enables the user to dig the hole 162 and berms 144 with less precision than otherwise required by other embodiments of the present invention.

The user then uses sand or other weighting material 132, such as pebbles or dirt, to weigh down the sand anchor region 120. This is accomplished by either using sand excavated from the hole 162, or from other available materials. The user can pile the weighting material 132 onto the sand anchor region 120, immediately above each of the sand anchors 122. The sand anchors 122 will engage the weighting material 132, by catching, holding and preventing it from sliding down the sand anchor region 120. Then, the user fills the pool 100 with water 170 or other liquid. Preferably, the user can use the waterproof fabric bag 50 as a bucket to scoop water 170 from the ocean or lake, and then pour it into the pool 100. On completion of the setup, the pool is configured as shown in FIGS. 10-11.

This configuration will enable the engaged sand anchors 118, the sand anchor region 120, and the water 170 in the filled pool 100 to weigh down and press against opposing sides of the sand berm 144, pulling the middle stabilizing region 114, and each of the sand stabilizers 118, down against the top 168 of the sand berm 144. This configuration will result in a push/pull effect that stabilizes the sand at the edge of the pool, minimizes the amount of deformation to the sand wall sides of the hole that might otherwise occur when children step on the edges or sides of the pool, prevents or minimizes the fabric of the pool from being pulled downward in a way that water will spill out of the edge of the pool, and in the event of localized deformation of the sand side wall or berm, prevents instability or failure of the entire sand side wall or sand berm.

When fully set up, children can play in the pool. When the user is ready to take the pool down, this process can be reversed. Preferably, the weighting material 130 is easily pushed off of the sand anchor region 120 at either side of each of the sand anchors 122. The sand stabilizers 118 are detached from and removed from the middle stabilizer region 114 by disengaging the sand stabilizer affixing means 116. Water 170 can be dipped out of the pool 100 with the bag 50, or any water 170 which has not been dipped out with the bag 50 can be simply dumped out into the hole 162 when the pool 100 is lifted. Finally, the pool 100 is folded and then stored in the waterproof fabric bag 50.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

I claim:

1. A portable wading pool comprising:

a fabric sheet with a base region, a stabilizer region and an anchor region;

wherein the base region is at the center of the fabric sheet and is comprised of a waterproof material, the stabilizer region is located radially outward from the base region, and the anchor region is located radially outwardly from the stabilizer region; and a removable stabilizer;

wherein the stabilizer region has a means for removably affixing the removable stabilizer to the stabilizer region.

2. The portable wading pool of claim 1 further comprising:

a sand anchor;

wherein the sand anchor is affixed to and projects upwardly from the sand anchor region.

3. The portable wading pool of claim 1 wherein the means for removably affixing is Velcro.

4. The portable wading pool of claim 3 wherein the means for removably affixing comprises a soft-loop portion of Velcro on the stabilizer region and a hard-hook portion of Velcro on the removable stabilizer.

5. The portable wading pool of claim 1 wherein the means for removably affixing enables the removable stabilizer to be affixed to a plurality of points on the stabilizer region.

6. The portable wading pool of claim 1 wherein the means for removably affixing enables the removable stabilizer to be affixed at a plurality of distances positioned radially outwardly from the base region.

7. The portable wading pool of claim 1 further comprising a plurality of removable stabilizers.

8. The portable wading pool of claim 1 wherein the fabric sheet is generally circular.

9. The portable wading pool of claim 1 wherein the sand anchor comprises a tubular segment of foam affixed along the outer edge of the fabric sheet.

10. The portable wading pool of claim 9 wherein the sand anchor is affixed by a fabric envelope attached to the fabric sheet.

11. The portable wading pool of claim 1 further comprising a protective binding at the edge of the fabric sheet.

12. The portable wading pool of claim 1 further comprising a plurality of sand anchors.

13. The portable wading pool of claim 1 wherein the base region is dark in color, such that the dark color will cause warming by the sun of water placed in the pool.

14. The portable wading pool of claim 13 wherein the waterproof fabric base is black in color.

15. The portable wading pool of claim 1 wherein the removable stabilizer is comprised of a closed-cell foam.

16. The wading pool of claim 15 wherein the foam is selected from the following: polyethylene, cross-linked polyethylene, expanded polystyrene, neoprene rubber and polyvinyl chloride nitrile butadiene rubber.

17. The wading pool of claim 1 further comprising a separate fabric bag, into which a user can fold and store the entire wading pool.

18. The wading pool of claim 17 wherein the separate fabric bag is waterproof.

19. A portable wading pool comprising:

a waterproof fabric sheet with a base region, a stabilizer region and an anchor region;

wherein the base region is at the center of the fabric sheet, the stabilizer region is located radially outward from the base region, and the anchor region is located radially outwardly from the stabilizer region;

wherein the stabilizer region further comprises a plurality of soft loop Velcro strips;

a removable stabilizer comprising a closed cell foam component and a hard-loop Velcro strip;

whereby the removable stabilizer may be removably affixed to the stabilizer region by engaging the hard-loop Velcro strip to at least one of the soft-loop Velcro strips.

20. The portable wading pool of claim 19 further comprising:

a sand anchor;

wherein the sand anchor is affixed to and projects upwardly from the sand anchor region.

21. A method for constructing a portable in-ground wading pool comprising:

providing a portable wading pool comprising:

a fabric sheet with a base region, a stabilizer region and an anchor region;

wherein the base region is at the center of the fabric sheet and is comprised of a waterproof material, the stabilizer region is located radially outward from the base region, and the anchor region is located radially outwardly from the stabilizer region;

a removable stabilizer;

wherein the stabilizer region has a means for removably affixing the removable stabilizer to the stabilizer region;

digging into the ground to excavate a hole, wherein the sides of said hole taper downwardly and inwardly;

forming a berm out of the same material as the ground that is taller than the surrounding ground surface and located along the edges of the hole;

placing said in-ground wading pool in the hole, such that the base region is in contact with the bottom and sides of the hole, and the inside sides of the berm, and further such that the stabilizer region is in contact with the top of the berm, and further such that the sand anchor region is in contact with the outside sides of the berm;

removably affixing the removable stabilizer to the stabilizer region by the means for removably affixing; and filling the waterproof base section of said in-ground wading pool with water.

22. The method of claim 21 further comprising:

wherein the portable wading pool further comprises:

a sand anchor;

wherein the sand anchor is affixed to and projects upwardly from the sand anchor region; and further comprising the step of:

placing at least some of the excavated ground onto the sand anchor region, radially above the sand anchor, such that the sand anchor engages and holds some of the excavated ground in place on the sand anchor, thereby weighing down the sand anchor region.

23. The method of claim 21 wherein the in-ground wading pool further comprises a separate waterproof bag and the filling step further comprises using the waterproof bag to carry and pour water into the waterproof fabric base of said in-ground wading pool.

* * * * *